US010186793B2

(12) United States Patent
Chen et al.

(10) Patent No.: US 10,186,793 B2
(45) Date of Patent: Jan. 22, 2019

(54) LIGHT CAP ELECTRICAL CONNECTION STRUCTURE

(71) Applicant: LEEDARSON LIGHTING CO. LTD., Zhangzhou, Fujian (CN)

(72) Inventors: Xiaobo Chen, Xiamen (CN); Ruifang Ma, Xiamen (CN); Maojin Zeng, Xiamen (CN)

(73) Assignee: LEEDARSON LIGHTING CO. LTD., Fujian (CN)

( * ) Notice: Subject to any disclaimer, the term of this patent is extended or adjusted under 35 U.S.C. 154(b) by 0 days.

(21) Appl. No.: 15/540,560

(22) PCT Filed: Dec. 31, 2015

(86) PCT No.: PCT/CN2015/100324

§ 371 (c)(1),
(2) Date: Jun. 28, 2017

(87) PCT Pub. No.: WO2016/155397

PCT Pub. Date: Oct. 3, 2016

(65) Prior Publication Data

US 2017/0373412 A1 Dec. 28, 2017

(30) Foreign Application Priority Data

Mar. 27, 2015 (CN) ..... 2015 1 0137952

(51) Int. Cl.
*H01R 12/57* (2011.01)
*F21V 23/00* (2015.01)
(Continued)

(52) U.S. Cl.
CPC ..... *H01R 12/57* (2013.01); *F21K 9/238* (2016.08); *F21V 23/004* (2013.01); *F21V 23/006* (2013.01); *F21V 23/06* (2013.01); *H01R 4/4809* (2013.01); *H01R 12/58* (2013.01); *H01R 24/20* (2013.01); *H01R 33/465* (2013.01); *H01R 2103/00* (2013.01)

(58) Field of Classification Search
CPC ..... H01R 12/57
See application file for complete search history.

(56) References Cited

U.S. PATENT DOCUMENTS

2012/0218748 A1* 8/2012 Conrad ..... F21V 19/0055 362/230
2013/0082595 A1* 4/2013 Yamamoto ..... F21V 3/00 315/50

(Continued)

*Primary Examiner* — Ross N Gushi
(74) *Attorney, Agent, or Firm* — Chun-Ming Shih

(57) ABSTRACT

A light cap electrical connection structure includes a driving board, a light cap body and a first electrode pin. The light cap body is a shell structure. One end of the first electrode pin is fixed on the light cap body and further including a socket. The socket is set on the driving board and includes a connection base and a first electrode. The first electrode is set on the connecting base and has a fixed end and a connecting end. The connecting end of the first electrode is an elastic structure. The other end of the first electrode pin is inserted into the light cap body and becomes an electrical connection in elastic contact with the connecting end of the first electrode. The light cap electrical connection structure has advantages of a simple structure and being easy to automate.

7 Claims, 3 Drawing Sheets

(51) Int. Cl.

| | |
|---|---|
| ***F21V 23/06*** | (2006.01) |
| ***H01R 4/48*** | (2006.01) |
| ***H01R 24/20*** | (2011.01) |
| ***H01R 12/58*** | (2011.01) |
| ***H01R 33/46*** | (2006.01) |
| ***F21K 9/238*** | (2016.01) |
| *H01R 103/00* | (2006.01) |

(56) References Cited

U.S. PATENT DOCUMENTS

2013/0083545 A1* 4/2013 Lui ..... F21V 3/02 362/363
2013/0114253 A1* 5/2013 Segawa ..... F21V 21/00 362/235
2013/0162139 A1* 6/2013 Liu ..... F21V 29/006 315/51
2013/0176708 A1* 7/2013 Mostoller ..... F21V 19/0055 362/95
2013/0201700 A1* 8/2013 Tamura ..... F21V 23/02 362/382
2013/0242558 A1* 9/2013 Sakai ..... F21V 15/01 362/249.02
2015/0098229 A1* 4/2015 Tamura ..... F21V 23/007 362/382
2015/0098230 A1* 4/2015 Tamura ..... F21V 19/005 362/382
2015/0103535 A1* 4/2015 Hu ..... F21V 31/00 362/363
2015/0117037 A1* 4/2015 Fan ..... F21V 23/005 362/375
2015/0219328 A1* 8/2015 Lee ..... F21K 9/233 362/235
2015/0252991 A1* 9/2015 Li ..... F21V 23/004 362/646
2015/0330580 A1* 11/2015 Reier ..... F21K 9/23 362/646
2015/0330621 A1* 11/2015 Min ..... F21V 29/773 362/363
2015/0338028 A1* 11/2015 Liang ..... F21V 23/005 362/249.02
2015/0369457 A1* 12/2015 Chang ..... H05K 1/189 362/311.14
2015/0377469 A1* 12/2015 Marinus ..... F21V 5/04 362/373
2016/0018087 A1* 1/2016 Gielen ..... F21V 17/005 362/249.01
2016/0025319 A1* 1/2016 Meyer ..... F21V 23/006 362/382
2016/0061386 A1* 3/2016 Chen ..... F21K 9/13 362/646
2016/0061423 A1* 3/2016 Fong ..... F21K 9/23 362/363
2016/0069547 A1* 3/2016 Chen ..... F21V 21/002 362/652
2016/0069555 A1* 3/2016 Chen ..... F21V 23/06 439/529
2016/0123542 A1* 5/2016 Ritzenhoff ..... F21K 9/90 362/249.01
2016/0146414 A1* 5/2016 Dong ..... F21S 10/046 362/232
2016/0146442 A1* 5/2016 Fong ..... H01R 12/714 362/363
2016/0161102 A1* 6/2016 Chou ..... F21V 29/773 362/249.02
2016/0193478 A1* 7/2016 Maxik ..... F21K 9/232 362/231
2016/0209018 A1* 7/2016 Johnson ..... F21V 25/125
2016/0238230 A1* 8/2016 Trottier ..... F21V 19/004
2016/0273751 A1* 9/2016 Xiao ..... F21V 23/006
2016/0290606 A1* 10/2016 Honold ..... F21V 25/04
2016/0380400 A1* 12/2016 Chen ..... H01R 33/22 439/620.02
2017/0051880 A1* 2/2017 Joye ..... F21K 9/238
2017/0074462 A1* 3/2017 Jiang ..... F21K 9/232
2017/0227170 A1* 8/2017 Wang ..... F21K 9/238
2017/0276338 A1* 9/2017 Chen ..... F21V 23/06
2017/0276339 A1* 9/2017 Chen ..... F21V 21/002
2017/0276340 A1* 9/2017 Chen ..... F21V 19/001

* cited by examiner

LIGHT CAP ELECTRICAL CONNECTION STRUCTURE

TECHNICAL FIELD

The present invention relates to the field of lighting, and more particularly to a light cap electrical connection structure.

BACKGROUND OF INVENTION

With rise of global awareness of environmental protection, an LED lighting used in a field of indoor lighting has been rapidly developed. In a current light cap structure, using an artificial welding wire way to achieve conductive connection from a light cap electrode pin to a driving board. Connecting two wires through the electrode pin in the driving board and riveting tight to achieve a purpose of connecting driving power. The connection way is not conducive to automated production because of needs to manually wear wires and wire, complicated production process, low production efficiency, wasting time and complicated process, and being difficult to install.

SUMMARY OF THE INVENTION

In view of this, it is necessary to provide a simple structure and easy to automate assembly of the light cap electrical connection structure.

The technical method in the invention is a light cap electrical connection structure. The light cap electrical connection structure includes a driving board, a light cap body and a first electrode pin. The light cap body is a shell structure. At least a part of the driving board is arranged above the light cap body or an inner side. One end of the first electrode pin is fixed on the light cap body and further including a socket. The socket is set on the driving board. The socket includes a connection base and a first electrode. The first electrode is set on the connecting base and has a fixed end and a connecting end. The fixed end of the first electrode is electrically connected with the driving board.

The connecting end of the first electrode is an elastic structure. The other end of the first electrode pin is inserted into the light cap body and becomes an electrical connection in elastic contact with the connecting end of the first electrode.

Comparing with the present invention, the light cap electrical connection structure is set with a socket on the driving board. The socket is set with a connecting base to fix the socket on the driving board and be set on the first electrode of the connecting base. The first electrode is electrically connected to the driving board. When ambling, the connecting end of the first electrode is elastically connected to the first electrode pin to realize the electrical connection of the light. Because the light cap connection structure of the electrical connection without artificial wire, threading and other processes and easy to install, the light cap electrical connection structure has advantages of a simple structure and being easy to automate.

DETAILED DESCRIPTION

Figure 1:
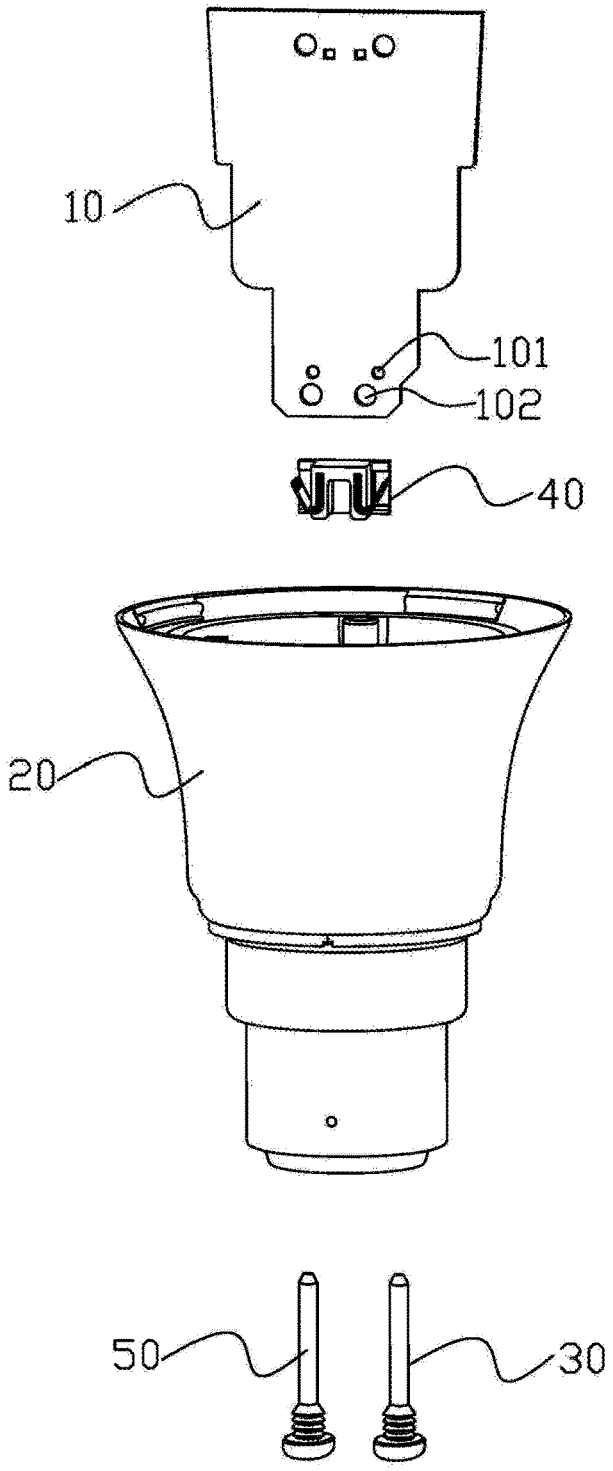
FIG. 1 is a perspective exploded view of a first embodiment to illustrate the light cap electrical connection structure of the present invention.
Figure 2:
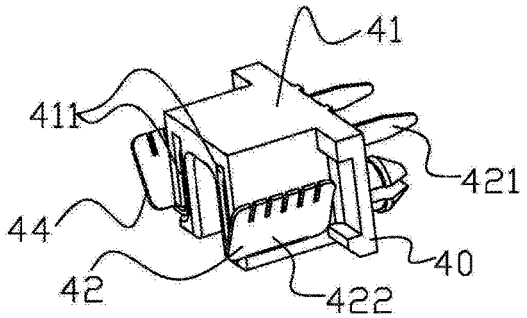
FIG. 2 is a perspective view of the socket in the light cap electrical connection structure shown in FIG. 1.
Figure 3:
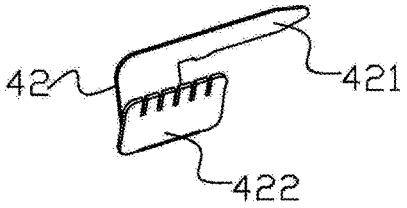
FIG. 3 is a perspective view of the first electrode in a socket shown in FIG. 2.
Figure 4:
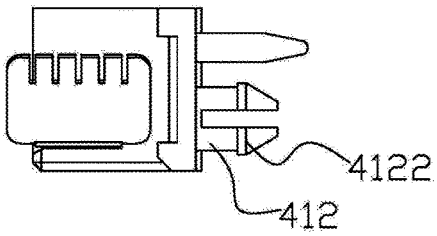
FIG. 4 is a right side view of a socket shown in FIG. 2.

The present invention may be described in detail with reference to specific examples:

FIG. 1 is a perspective exploded view of a first embodiment to illustrate the light cap electrical connection structure of the present invention. The light cap electrical connection structure includes a driving board 10, a light cap body 20 and a first electrode pin 30. The light cap body 20 is a shell structure. At least a part of the driving board 10 is arranged above the light cap body 20 or an inner side.

Figure 5:
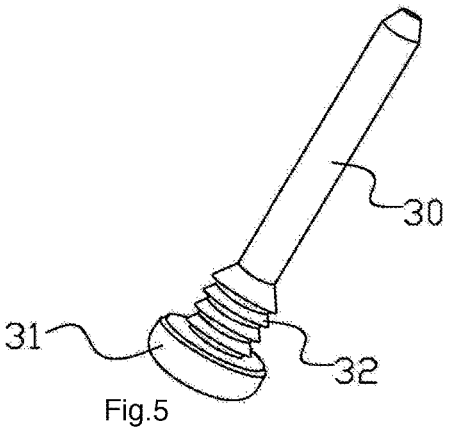
FIG. 5 is a perspective view of the first electrode pin shown in FIG. 1.
Figure 6:
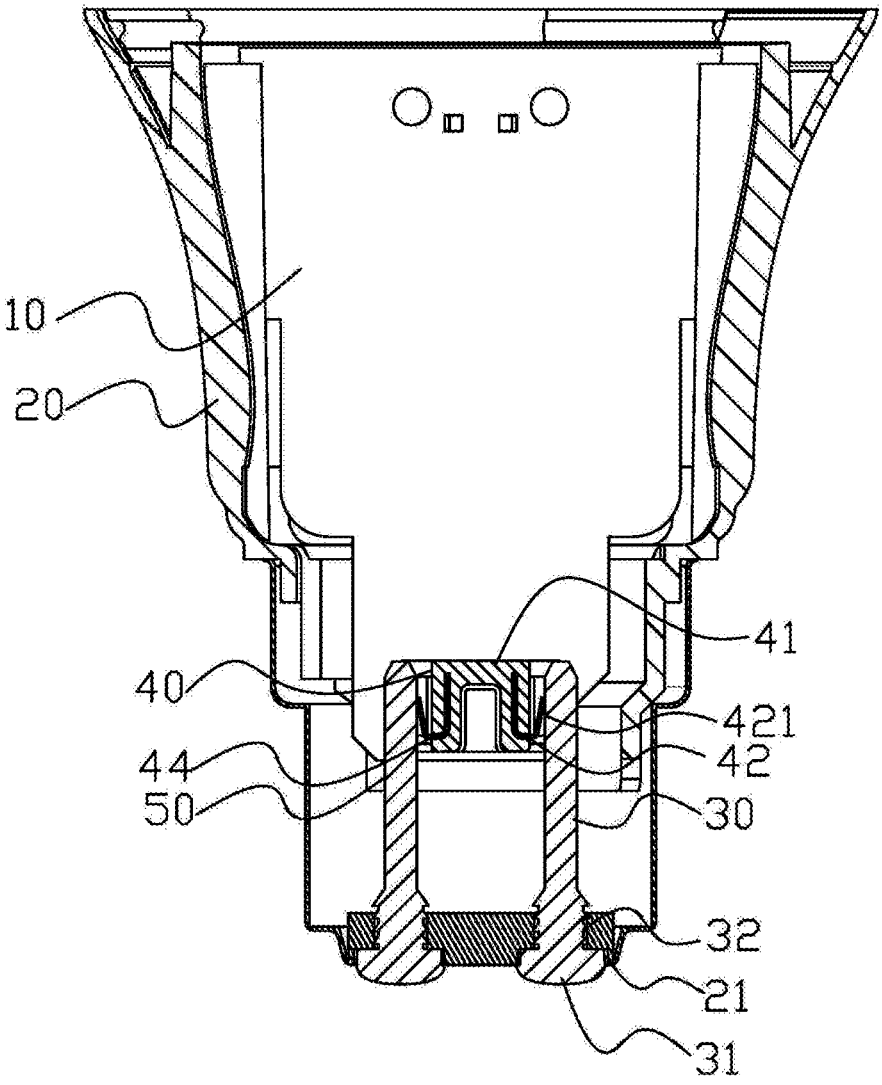
FIG. 6 is a cross-sectional view of the light connector structure shown in FIG. 1.

Please refer to FIG. 5 and FIG. 6, one end of the first electrode pin 30 is fixed on the light cap body 20, and the outer end of the first electrode pin 30 is set with a lamella 31, and the bottom of the light cap body 20 is set with an installation slot 21 corresponding to the lamella 31. Further, the lamella 31 may be set in an oval or rectangular structure so as to make it difficult to rotate when the lamella 31 is fixed. One end of the first electrode pin 30 is set with a toothed structure 32. The first electrode pins 30 are fixed to the light cap body 20 through the toothed structures 32.

Please refer to FIG. 1 to FIG. 4, the light cap electrical connection structure further includes a socket 40. The socket 40 is set on the driving board 10. The socket includes a connecting base 41 and a first electrode 42. The first electrode 42 is set on the connecting base 41. The connecting base 41 is set with an installation column 412. Elastic anti-off barbs 4122 are set on free end of the installation columns 412. An installation through hole 102 is set on the driving board. The installation columns 412 is inserted into the installation through hole 102 to use the elastic anti-off barbs 4122 to hold the driving board 10 to make the connecting base 41 fix on the driving board 10.

Please refer to FIG. 1 to FIG. 4, the first electrode 42 has a fixed end 421 and a connecting end 422. The connecting base 41 is set with a groove 411, and the fixed end 421 of the first electrode is correspond inserted to a groove 411. The fixed end 421 of the first electrode 42 is electrically connected to the driving board 10. Specifically, the fixed end 421 of the first electrode 42 is a pin structure, and the driving board is set with an inserted hole 101, and the fixed end 421 of the first electrode is respectively inserted into the inserted hole 101 and is electrically connected to the driving circuit of the driving board. The connecting end 422 of the first electrode 42 is an elastic structure, and the connecting end 422 of the first electrode 42 is a bent metal shrapnel structure. The bottom of the connecting end 422 of the first electrode 42 is a comb-like structure so that the connecting end 422 has better elasticity. The other end of the first electrode pin 30 is inserted into the light cap body 20 so as to form electrical connection with the connecting end 422 of the first electrode 42.

Please refer to FIG. 2 to FIG. 6, further including a second electrode pin 50 and a second electrode 44. The second electrode 44 has the same structure as the first electrode 42 and both are fixed to the connecting base 41. The second electrode pins 50 and the first electrode pins 30 are insulated from each other and are fixed to the light cap body 20, and the second electrode pins 50 are electrically connected to the second electrode 44.

In view of the above, the light cap electrical connection structure is set with a socket 40 on the driving board 10. The socket 40 is set with a connecting base 41 to fix the socket on the driving board 10 and be set on the first electrode 42 of the connecting base 41. The first electrode 42 is electrically connected to the driving board 10. When ambling, the connecting end 422 of the first electrode 42 is elastically connected to the first electrode pin 30 to realize the electrical connection of the light. Because the light cap connection structure of the electrical connection without artificial wire, threading and other processes and easy to install, the light cap electrical connection structure has advantages of a simple structure and being easy to automate.

The above statement is intended only as a preferred embodiment of the present invention and is not intended to limit the invention. Any modification, equivalent substitution, improvement, and the like, which are within the spirit and principles of the invention may be included in the scope of protection.

The invention claimed is:

1. A light cap electrical connection structure comprising:

a driving board;

a light cap body; and a first electrode pin, the light cap body being a shell structure and at least a part of the driving board being arranged above the light cap body or an inner side, one end of the first electrode pin being fixed on the light cap body, wherein one end of the first electrode pin is inserted into a socket, the socket is set on the driving board and the socket comprises a connecting base and a first electrode, the first electrode is set on the connecting base and has a fixed end and a connecting end, and the fixed end of the first electrode is electrically connected with the driving board, the connecting end of the first electrode is an elastic structure, when the other end of the first electrode pin is inserted into the light cap body, the first electrode pin has an electrical connection in elastic contact with the connecting end of the first electrode.

2. The light cap electrical connection structure of claim 1, wherein the connecting end of the first electrode is a bent metal structure.

3. The light cap electrical connection structure of claim 2, wherein the bottom of the connecting end of the first electrode is a comb-like structure.

4. The light cap electrical connection structure of claim 1, wherein the fixed end of the first electrode is a pin structure, and the driving board is set with an inserted hole, and the fixed end of the first electrode is respectively inserted into the inserted hole and is electrically connected to the driving circuit of the driving board.

5. The light cap electrical connection structure of claim 1, wherein the connecting base is set with an installation column, elastic anti-off barbs are set on free end of the installation columns, an installation through hole is set on the driving board, the installation columns is inserted into the installation through hole to use the elastic anti-off barbs to hold the driving board to make the connecting base fix on the driving board.

6. The light cap electrical connection structure of claim 1, wherein one end of the first electrode pin is set with a toothed structure, and the first electrode pins are fixed to the light cap body through the toothed structures.

7. The light cap electrical connection structure of claim 1, wherein the light cap electrical connection structure comprises a second electrode pin and a second electrode, the second electrode has the same structure as the first electrode and both are fixed to the connecting base, the second electrode pins and the first electrode pins are insulated from each other and are fixed to the light cap body, and the second electrode pins are electrically connected to the second electrode.

* * * * *